US005394810A

United States Patent [19]

Howard et al.

[11] Patent Number: 5,394,810

[45] Date of Patent: Mar. 7, 1995

[54] FOLDABLE FURNITURE

[75] Inventors: John R. Howard, West Chicago; Robert W. Machacek, Lombard, both of Ill.

[73] Assignee: HMV Enterprises, Inc., Addison, Ill.

[21] Appl. No.: 33,887

[22] Filed: Mar. 18, 1993

[51] Int. Cl.[6] ..... A47B 3/00

[52] U.S. Cl. ..... 108/165; 108/157

[58] Field of Search ..... 108/165, 162, 167, 171, 108/153, 156, 157; 297/440.12

[56] References Cited

U.S. PATENT DOCUMENTS

| | | | |
|---|---|---|---|
| 2,361,875 | 10/1944 | Sachs | 108/165 |
| 3,212,464 | 10/1965 | Steuer | 297/440.12 X |
| 3,220,362 | 11/1965 | Downes | 297/440.12 X |
| 3,566,808 | 3/1971 | Slate, Jr. | 297/440.12 X |
| 3,727,979 | 4/1973 | Schier et al. | 297/440.12 |
| 3,729,244 | 4/1973 | Butler . | |
| 3,837,719 | 9/1974 | Barron | 297/440.12 X |
| 3,871,726 | 3/1975 | Stegner | 297/440.12 X |
| 4,333,622 | 6/1982 | Albano | 108/165 X |
| 4,648,658 | 3/1987 | Calco | 297/440.12 |
| 4,653,817 | 4/1987 | Sheffer . | |

*Primary Examiner*—Jose V. Chen

*Attorney, Agent, or Firm*—Patnaude, Videbeck & Marsh

[57] ABSTRACT

An item of foldable furniture has a first blank for a top portion and one or more second blanks for pedestals. The top blank is rectangular in shape with a plurality of parallel scores such that the blank may be folded for storage and shipping. A first score midway along the length of the first blank such that the top of the furniture is folded along its longitudinal centerline and has second and third scores such that the item of furniture may be folded and inserted into a package for shipping. Each pedestal is constructed of a second blank which also has a plurality of longitudinal scores dividing the pedestal blank into sections. When the ends of the pedestal blank are joined, a pedestal is formed. A double score is provided between a first and a second of the sections of the pedestal such that the first and second sections can be folded around a third and fourth section in order that the pedestal may be folded for storage and shipping along with the top.

11 Claims, 6 Drawing Sheets

FOLDABLE FURNITURE

This invention relates to foldable furniture, such as a table, which may be constructed of corrugated cardboard or the like and can be collapsed to a size which is suitable for handling by a commercial carrier.

BACKGROUND OF THE INVENTION

The construction of a foldable table is shown in U.S. Pat. No. 3,212,464. Such tables are inexpensive to manufacture and are readily disposable, and there are numerous uses for such tables. Currently available foldable tables, however, cannot be collapsed to a size having a length and a width less than the length and width of the top of the table. A typical table which is suitable for general use has a top of about 32 inches wide and 55 inches in length and a package for containing a foldable table of the type presently known in the art must be at least as large as the top.

A foldable table or other item of furniture can be manufactured of corrugated cardboard and stored in packages, with one item of furniture to a package, and retained indefinitely in the warehouse of a supplier or of a user. When there is a need for such furniture, the desired number can be withdrawn from storage and sent to the desired location where they can be assembled and used. After use, the furniture can be either disassembled and stored again, or they may be discarded. If it is made of corrugated cardboard, such furniture can be made of recycled products, and the discarded furniture can itself be recycled and, therefore, such furniture is not environmentally harmful.

It is frequently desired to transport such disposable furniture including tables using common carriers. Such common carriers use conveyor belts and the like to transfer goods from a receiving station to a loading station, and from a loading station to a carrier such as an airplane or a railroad car. The conveyors are adapted to transport packages having certain maximum dimensions, and packages within the dimensional limitations are moved by such conveyors and around the curves thereof without damage. However, where the item of furniture is a foldable table suitable for general use, such existing tables require packages the outer dimensions of which exceed the design limits of conveyor systems currently used by common carriers. When a package containing an existing foldable table is placed upon a conveyor for a common carrier, it is typically placed flat upon the conveyor and if the conveyor has a turn during the course of its passage, the table will not negotiate the turn, but will become blocked. Thereafter, other packages will become congested behind the foldable table and they will ultimately force the foldable table around the turn causing the table and its container to become damaged. As a result, common carriers cannot be used to transport foldable tables presently known in the art.

Furthermore, existing items of foldable furniture are packaged in containers which have the general shape of the upper surface of the furniture, and such packages are awkward to handle and can become easily bent or damaged during storage or transportation thereof. It would be desirable to provide a foldable furniture which may be configured as a table, a bench or a cot and which, when disassembled and packaged for storage or delivery, and will have outer dimensions which are substantially less than the dimensions of the upper surfaces of the erected item of furniture.

SUMMARY OF THE INVENTION

The present invention is a foldable item of furniture constructed of a plurality of blanks of stiff, foldable material, such as cardboard, corrugated board, or the like. The furniture has a first blank having a pair of symmetrical opposing edges and a first score positioned midway between the opposing edges and two second scores, one on each side of the first score. The second scores define the outer edges of a top which may be folded in half longitudinally along the centrally located first score to define a first half and a second half of the top.

The first blank further has two third scores, one third score positioned between each second score and the adjacent opposing edge to define a first and a second side section, the first side section adjacent the first half of the top and the second side section adjacent the second half of the top, and define a first and a second support section, the first support section adjacent the first side section and the second support section adjacent the second side section.

Each of the side sections have one or more cut out portions therein and the cut out portions of the second side section are positioned complementary to the position of the cut out portions of the first side section. The first panel can be folded along the second and third scores to form a top of an item of furniture with the cut out portions of the first side section mating with the complementary cut out portions of the second side section to form one or more openings for receiving a pedestal of the item of furniture. The invention further includes at least one second blank of material which may be folded into a pedestal. Each second blank has a pair of opposing outer edges and a plurality of scores which divide the second blank into a plurality of sections in side-by-side relationship between the pair of opposing outer edges. The outer edges are joined together to form a pedestal having a plurality of rectangular sections.

A pedestal having four rectangular sections has a first and a second section positioned adjacent each other, and a third section adjacent the first section, and a fourth section adjacent the second section. The width of the first section is a little wider than the width of the third section, and the width of the second section is a little wider than the width of the fourth section, and a double score is positioned between the first and second sections.

For the purpose of storing and shipping, a pedestal as constructed above can be collapsed and folded with the first and second sections folded around the third and fourth sections. Similarly, the first panel can be folded along the first, second and third scores, and placed with the associated blanks for pedestals into a container having dimensions which are substantially less than the dimensions of the top of the erected item of furniture. Such furniture, when configured as a table, bench, cot or the like will fit within a container which can be sent by common carrier and will not exceed the design limits of the conveyors used. As a result, such furniture can be sent by common carrier substantially without damage.

BRIEF DESCRIPTION OF THE DRAWINGS

A better understanding of the present invention can be had by a reading of the following detailed description taken in conjunction with the accompanying drawings wherein.

DETAILED DESCRIPTION OF A PREFERRED EMBODIMENT

Figure 1:
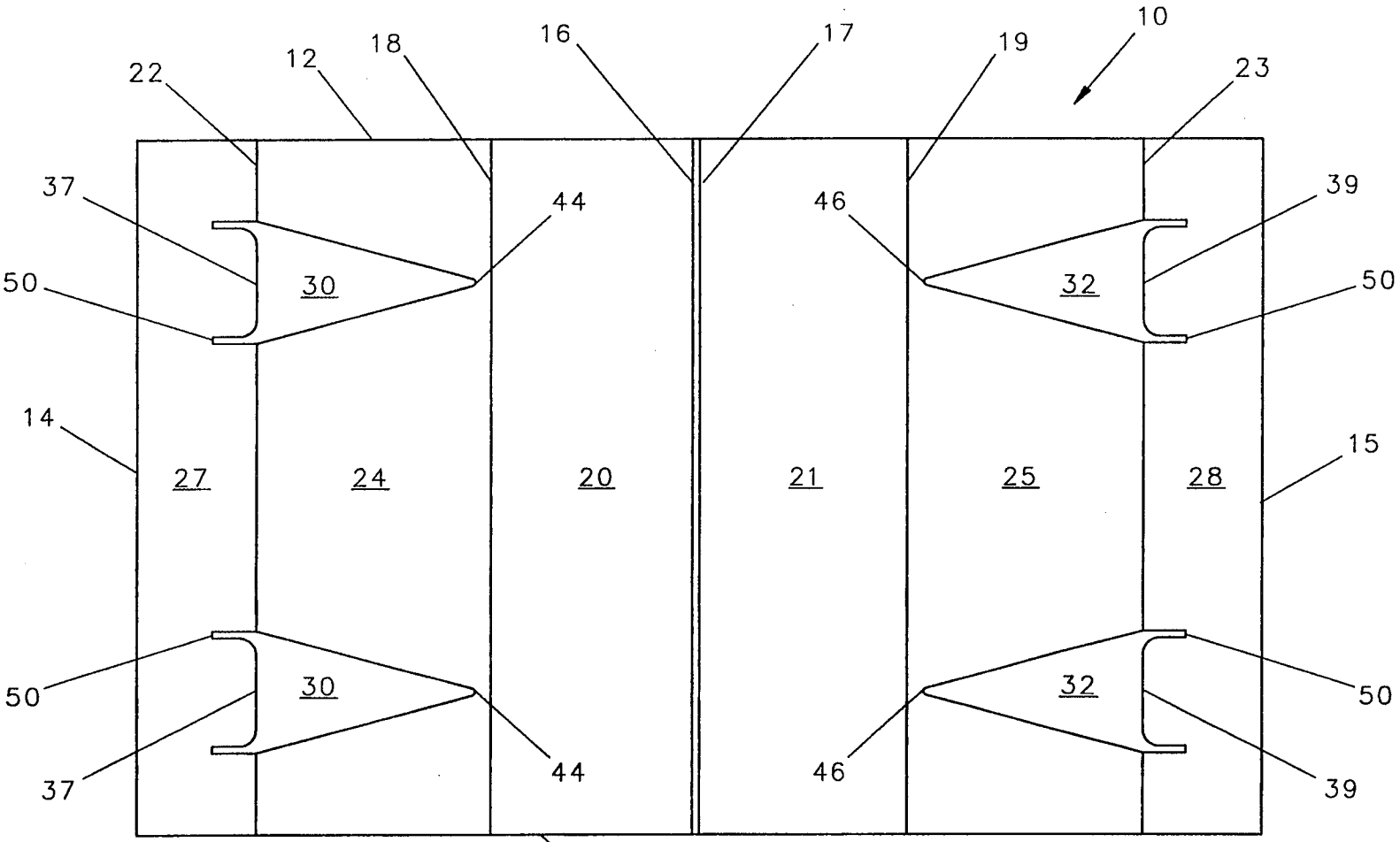
FIG. 1 is a plan view of a blank suitable for assembly into a top of a table in accordance with the present invention.

Referring to FIG. 1, a table in accordance with the present invention has a top made from a first blank 10 of foldable material such as corrugated board which is generally rectangular in shape having a pair of opposing long edges 12, 13 and a pair of opposing short edges 14, 15. To form a table having top dimensions of 55 inches by 32 inches, the long edges 12, 13 of the blank 10 should be approximately 84 inches in length and the short edges 14, 15 should be approximately 55 inches in length.

In accordance with the present invention, parallel to the short edges 14, 15, and midway between the short edges 14, 15 is a pair of centrally located first scores 16, 17. Each of the first scores is a crease in the foldable material to facilitate the folding of the blank 10 and, therefore, the scoring should be undertaken without causing a perforation of the material of the blank. Where the foldable table is to be constructed of corrugated cardboard, the center scores 16, 17 should be spaced apart a small distance of approximately ¾ inches, and unlike the second and third scores as hereafter described, the first scores 16, 17 should be made into the underside of the blank so that the usable surface of the erected table is unscored.

Outwardly from the first scores 16, 17 and parallel thereto are a pair of second scores 18, 19, one of the second scores 18, 19 positioned on each side of the first scores 16, 17. The second scores 18, 19 are equally distant from the adjacent one of the first scores 16, 17 and they define adjacent first and second equal rectangular top sections 20, 21 separated by the first scores 16, 17.

The blank 10 further has a pair of third scores 22, 23 each of which is parallel to the outer edges 14, 15 and one of which is positioned outward of each of the second scores 18, 19. The third score 22 defines a first side section 24 which is positioned adjacent to and outward of the first top section 20, and also defines a first support section 27 positioned adjacent to and outward of the first side section 24. Similarly, the third score 23 defines a second side section 25 positioned adjacent to and outward of the second top section 21, and a second support section 28 positioned adjacent to and outward of the second side section 25. The third scores 22, 23 are positioned such that the widths of the side sections 24, 25 are equal to each other and the width of the support sections 27, 28 are equal to each other. For a table top having dimensions of 55 inches by 32 inches, each of the second scores should be positioned about 16 inches from the adjacent first score, and each of the third scores should be positioned about 18 inches from the adjacent second scores. The third scores should also be positioned about 8 inches from each of the outer edges.

As can be seen in FIG. 1, each of the side sections 24, 25 has at least one triangular cut out section therein. The first side section 24 has triangular cut out sections 30 and the second side section 25 has complementary located cut out sections 32 therein. Each of the triangular cut out sections 30, 32 has a base portion 37, 39, respectively, which is positioned along the third score 22, 23, associated with the side section 24, 25, and each of the cut out sections 30, 32 has an apex 44, 46. The apex 44, 46 is positioned a short distance from the associated second score 18, 19 so as to space the apex 44, 46 from the edge of the erected table and thereby protect the edge of the top of the table if tearing should occur at the apex 44, 46. Also, the dimensions of the cut out sections 30 of the first side section 24 are substantially the same as the dimensions of the cut out section 32 of the second side section 25.

The blank 10 is further provided with a plurality of notches 50 which are positioned at the ends of the bases 37, 39 of the cut out sections 30, 32 and extend parallel to the long edges 12, 13. The notches 50 all have widths and depths suitable for receiving a complementary notch in a pedestal as hereinafter described when the blank 10 is folded into its erected configuration.

Figure 3:
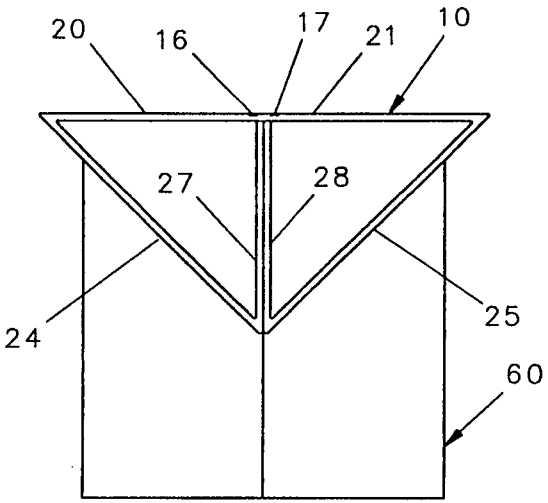
FIG. 3 is an end elevational view of an assembled table having the top of FIG. 1 and a pedestal assembled from the blank shown in FIG. 5.
Figure 2:
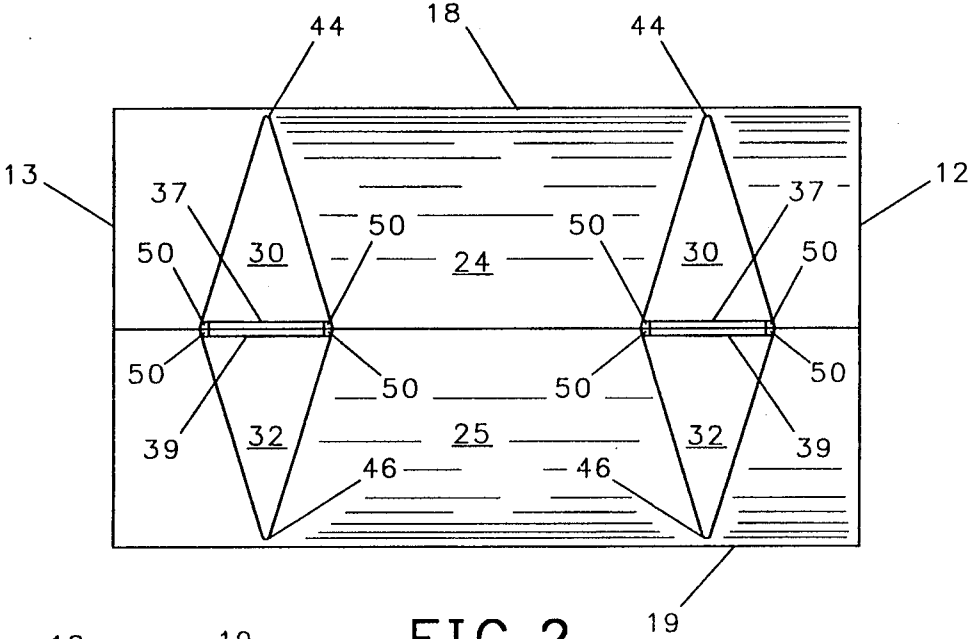
FIG. 2 is a bottom view of the blank shown in FIG. 1 folded for use as a table top prior to the insertion of the pedestals.

Referring to FIGS. 2 and 3, the sections of the blank 10 are sized such that the width of each of the side sections 24, 25 is a little wider than that of each of the top section 20, 21 and the width of each of the support sections 27, 28 is a little narrower than the width of each of the top sections 20, 21. When the blank 10 is folded into its erected configuration, the side sections 24, 25 are folded under the top sections 20, 21 and the support sections 27, 28 are positioned to extend vertically below the first scores 16, 17 as can be seen in FIG. 3. As can be seen in FIG. 2, when the blank 10 is folded as described above, each pair of opposing openings 30, 32 mate to form a quadrangular opening for receiving a pedestal.

Figure 5:
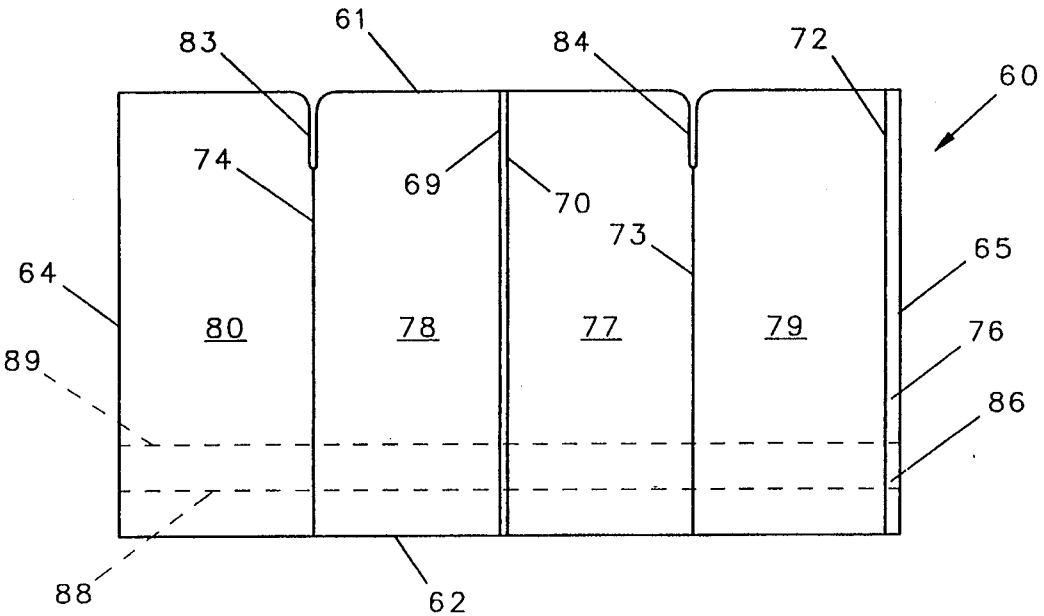
FIG. 5 is a plan view of a blank suitable for assembly into a pedestal in accordance with the present invention.

Referring to FIG. 5, the preferred embodiment provides for one or more pedestals, each of which is formed from a second blank of which one blank 60 is portrayed. The second blank 60 is rectangular in shape and has upper and lower edges 61, 62, respectively, and a pair of opposing shorter edges 64, 65. Extending parallel to the shorter edges 64, 65 and approximately midway between the shorter edges 64, 65 is a double score 69, 70, in accordance with the present invention. Where the blank 60 is made of a corrugated cardboard, the distance between the double scores 69, 70 should be about $\frac{3}{4}$ inches.

Parallel to one of the outer edges 65, and a short distance therefrom is a score 72 which defines a narrow strip of material 76. Approximately midway between the double score 69, 70 and the score 72 and parallel thereto is a score 73 such that score 73 and double score 69, 70 define a first rectangular section 77, and scores 72 and 73 define a third rectangular section 79. Similarly, approximately midway between the double score 69, 70 and the opposing outer edge 64 and parallel thereto is a score 74 such that score 74 and double scores 69, 70 define a second rectangular section 78 and score 74 and outer edge 64 define a fourth rectangular section 80. The four sections 77, 78, 79, 80 are in side-by-side relationship.

The blank 60 further has a pair of notches 83, 84 which are parallel to the short edges 64, 65 and positioned along the upper edge 61 at the intersection therewith of scores 73 and 74. The notches 83, 84 are adapted to mate with the notches 50 of the blank 10 when the blanks are assembled into an item of furniture as described below.

Figure 6:
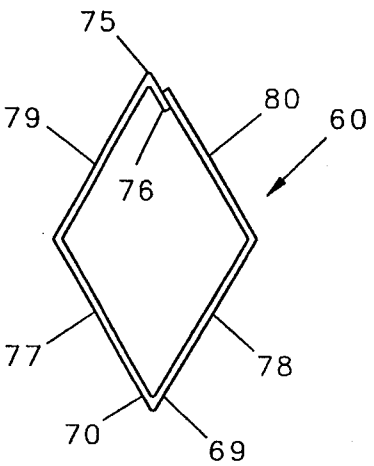
FIG. 6 is a top view of the blank shown in FIG. 5 with the outer edges attached to each other to form a pedestal for insertion into the openings in the table top shown in FIG. 2.

An adhesive material 84 is provided on one side of the strip 76 which can be attached to a portion of section 77 adjacent the short edge 64 to assemble the blank 60 into a pedestal as shown in FIG. 6. The sections 77, 78, 79, 80 of the assembled pedestal have widths which are adapted to fit within the quadrangular openings formed by cut out sections 30, 32 and the notches 83, 84 of the pedestal are adapted to receive the corresponding notches 50 of the blank 10 when it is in the erected configuration such that the pedestal 60 and top 10 will be mutually retained in assembled relationship.

Figure 4:
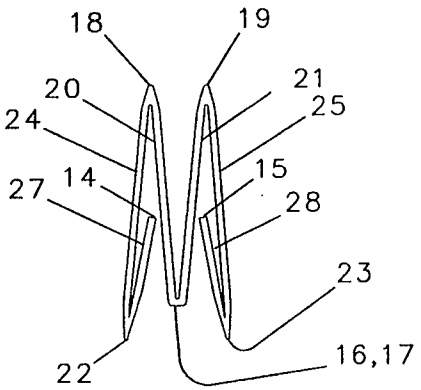
FIG. 4 is an end view of the table top of FIG. 1 folded for storage and shipping.

As can be seen in FIG. 4, the blank 10 which forms the top of a table can be collapsed and folded along the first, second and third scores 16, 17, 18, 19, 22, 23. The double score 16, 17 permits the top sections 20, 21 to be folded against one another without causing damage to the corrugated cardboard, and as a result when the table is subsequently erected, the surface of the table will remain flat. One familiar with corrugated cardboard will appreciate that when such material is folded upon itself along a single score, such folding damages the corrugated material and once it is folded, it will not return to a flat surface when the material is unfolded. Such damage to the corrugated board will not occur where a double score is provided. Also, where the double score is made to the under side of the top, the usable upper surface of the top will be level when it is erected.

As shown in FIG. 3, when the blank 10 is folded into the erected configuration, the support sections 27, 28 are positioned immediately below the first scores 16, 17 and provide support thereto. As a result thereof, the assembled table will retain its strength along the centerline notwithstanding the double score 16, 17 therein.

Figure 7:
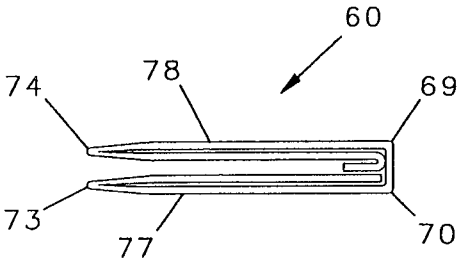
FIG. 7 is a top view of the pedestal shown in FIG. 5 collapsed for storage and shipping.

Referring to FIG. 6 and FIG. 7, section 79 of the blank 60 has a width, defined as the distance between the scores 69 and 73, which is a little wider than the width of section 80, and section 78 has a width a little wider than the width of section 77. Also, section 78 and 79 are adjacent to each other and separated by the double score 69, 70. Where the pedestals are made of corrugated cardboard, the wider sections 78, 79 should be about 0.02 inches wider than the corresponding narrower sections 77, 80. As a result of the differences of length of the sections as described above, and the double scores 69, 70, the assembled blank 60 can be folded upon itself into a flat configuration for packaging and transporting as shown in FIG. 7.

The height of an erected table is determined by the distance between the upper and lower edges 61, 62 of the blank 60. For a typical table the upper and lower edges 61, 62 may be spaced 36 inches apart, however, the blank 60 may also have spaced markings 88, 89 on the surface thereof which are parallel to the lower edge 62 along which the blank 60 may be cut by a user to provide for a lower table.

As can be seen in FIG. 4 and FIG. 7, the blank 10 can be collapsed and fit into a package which has a width approximately half the width of the erected table and similarly the pedestals formed from second blanks 60 can be collapsed into a configuration having a width which is nearly equal to the width of one of the top section 20, 21 of the table top. As a result, a blank 10 folded in the configuration shown in FIG. 4 can be packaged along with the appropriate number of blanks 60 assembled and folded into the configuration shown in FIG. 7 for the purposes of shipping and storing.

It will be apparent from a reading of the foregoing that a plurality of blanks constructed and packaged as described above can be erected into a single foldable table and yet be fitted into a compact package. When the blanks are adapted to assemble into a table top which has a width of 32 inches and a length of 55 inches and the table having a height of 36 inches, the packaged blanks can fit into a container having a length of 56 inches, a width of 18-$\frac{3}{4}$ inches, and a thickness of 3-$\frac{3}{4}$ inches. Containers having the dimensions set forth above can readily be sent by common carrier to a destination without suffering damage in transportation and without becoming caught in the bends of conveyor systems normally used by common carriers.

Second Embodiment

Figure 8:
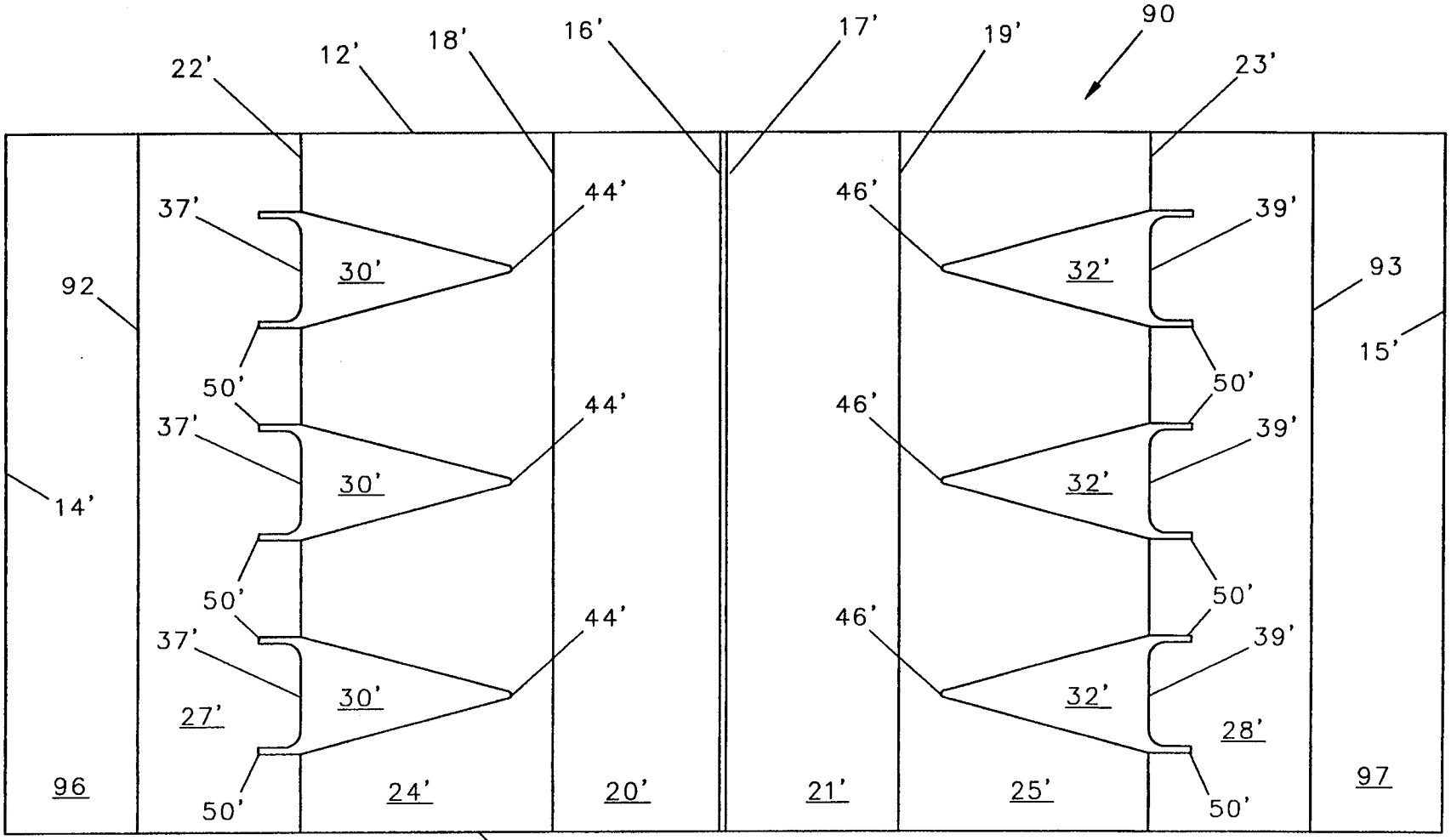
FIG. 8 is a plan view of a blank suitable to be folded into the top of a bench in accordance with the present invention.
Figure 9:
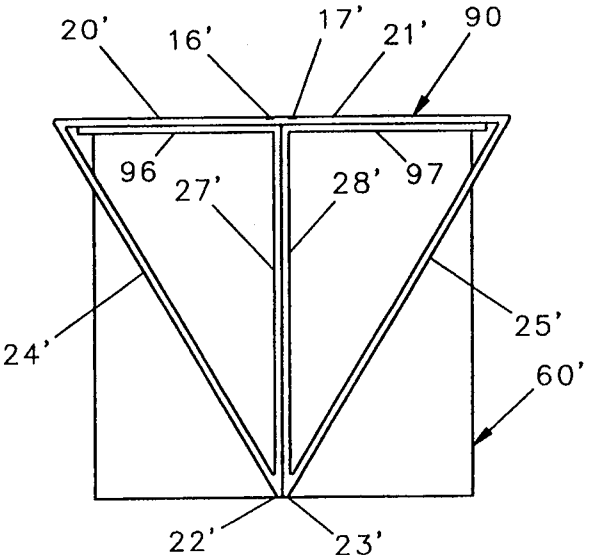
FIG. 9 is an end elevational view of a bench having a top assembled from the blank shown in FIG. 8.
Figure 10:
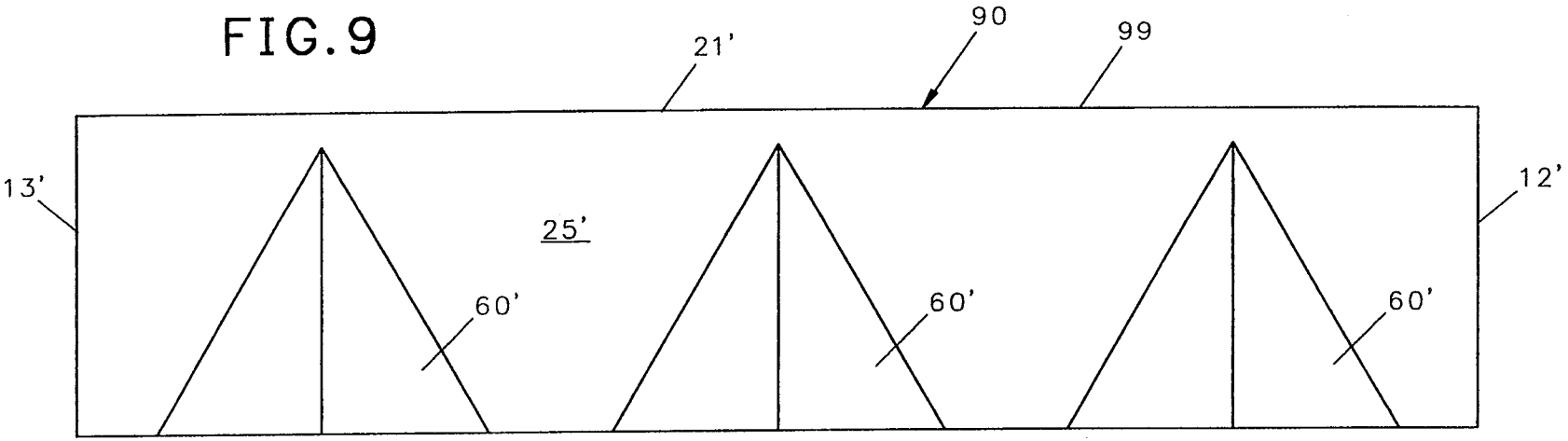
FIG. 10 is a side view of a bench having the top assembled from the blank shown in FIG. 8.

Referring to FIGS. 8, 9 and 10, in which a blank 90 is folded into a configuration adaptable for use as a bench or a cot, elements of blank 90 which are like elements of blank 10 have like indicia numbers except that that the indicia numbers for blank 90 are primed.

As was provided with blank 10, blank 90 has double first scores 16', 17', and outward of the first scores are second scores 18', 19', respectively Outward of the second scores are third scores 22', 23'. Outward of each of the third scores 22', 23', blank 90 has a pair of fourth scores 92, 93, each of which is positioned outward of one of the third scores 22', 23' and between one of the third scores 22', 23' and an adjacent outer edge 14', 15'. The fourth score 92 defines a support section 27' positioned between the third score 22' and fourth score 92, and defines a reinforcing section 96 extending between fourth score 92 and outer edge 14'. Similarly, fourth score 93 defines a support section 28' between the third score 23' and fourth score 93, and defines a reinforcing section 97 between the fourth score 93 and the outer edge 15'. As with the blank 10, the width of the two top sections 20', 21' are equal to each other, the widths of the two side sections 24', 25' are equal to each other, the width of the support sections 27', 28' are equal to each other, and the widths of the reinforcing sections 96, 97 are equal to each other.

Referring to FIG. 9, it can be seen that the widths of each of the side sections 24', 25' is substantially wider than the width of the adjacent top sections 20', 21', and further each of the support sections 27', 28' is wider than each of the top sections 20', 21'. In this embodiment, the reinforcing sections 96, 97 have widths which are a little shorter than the width of each of the top sections 20', 21'. When folded into the erected configuration as shown in FIG. 9, the side sections 24', 25' are folded inward and below the top sections 20', 21' and the support sections 27', 28' extend vertically below the center scores 16', 17' similar to the folding of the first blank 10. In this embodiment, however, the reinforcing sections 96, 97 are positioned underneath the corresponding top section 20', 21' and parallel to the top sections to provide reinforcing support thereto. The reinforcing sections 96, 97 are retained against the bottoms of the top sections 20', 21' when the furniture is erected by the upper edges 61' of the second blanks 60'.

The second blanks 60' for this embodiment again consist of four rectangular sections having nearly equal widths such that they can be folded as previously described. As shown in FIGS. 9 and 10, the height of the blank 60', where the height is the distance between the upper and lower edges 61, 62, is substantially equal to the width of the support sections 27', 28'. As a result, the third scores 22', 23' of the blank 90 will rest upon the flooring which supports the pedestal 60' when the furniture is erected. In this embodiment, there are three pedestals 60' so as to maximize the support to the upper surface 99 in order that it may bear a maximum load. As a result, a number of people may be seated upon furniture which is dimensioned so as to be usable as a bench and constructed in accordance with the second embodiment. Alternately, substantially the same configuration may be used to construct a cot which would bear the weight of a reclining person.

Figure 11:
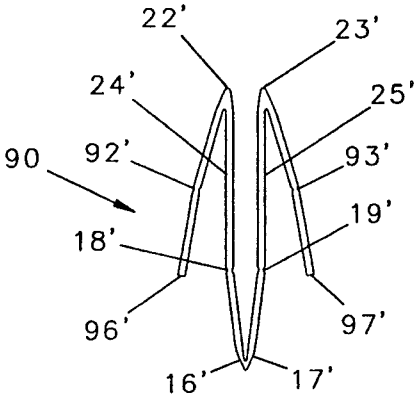
FIG. 11 is an end elevational view of the top shown in FIG. 8 collapsed for storage and shipping.

When the blank 90 is configured as a bench, the widths of the various sections 20', 21', 24', 25', 27', 28', 96, 97 are narrower than for a blank which is configured as a table or a cot and, therefore, a blank 90 usable as a bench can be folded as shown in FIG. 11. In this configuration the blank 90 is folded along the first scores 16', 17' and the third scores 22', 23', but the second scores 18', 19' and the fourth scores 92, 93 are left unfolded. Blanks 90 usable as benches can be folded as described above and packaged along with a table as previously described without substantially altering the size of the table package.

Figure 13:
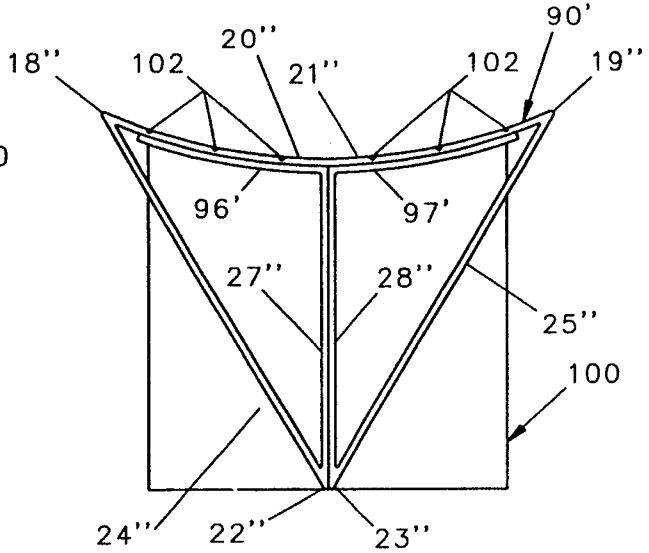
FIG. 13 is an end elevational view of a cot having a top similar to that formed from the blank shown in FIG. 8 and a pedestal formed from the blank shown in FIG. 12.
Figure 12:
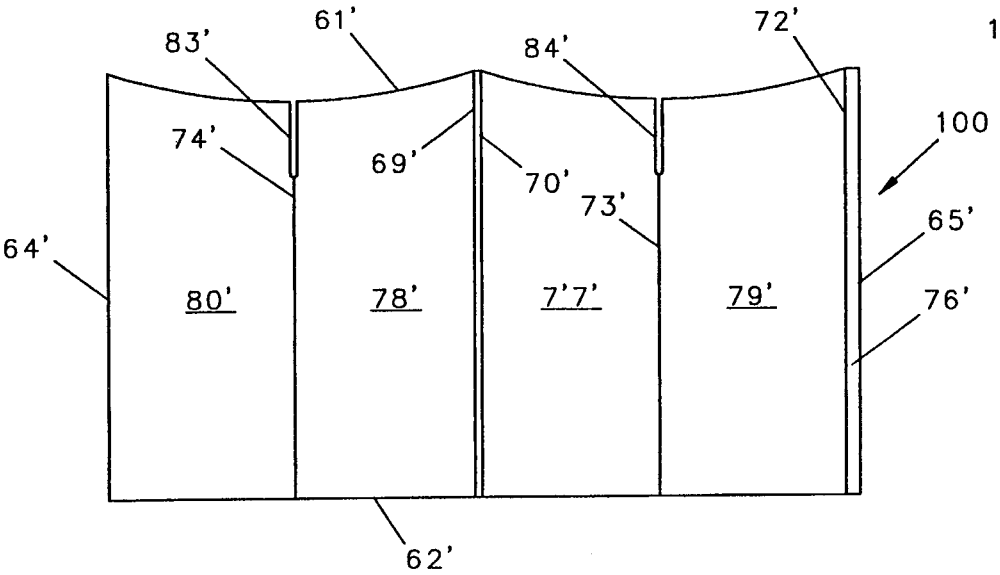
FIG. 12 is a plan view of a second embodiment of a blank suitable for assembly into a pedestal in accordance with the present invention.

Referring to FIG. 12 and 13, a second embodiment of a blank 100 suitable for forming into a pedestal as portrayed. The elements of the blank 100 which are like elements in the blank 60 bear indicia numbers which are like those used for the blank 60 except that they are primed. In this embodiment, the pedestal formed from the assembled blank 100 is adapted for use for furniture sized and configured for use as a cot. As can be seen, the upper edge 61' is not straight, but it is curved such that the height of the assembled pedestal is at a maximum along scores 73' and 74', and at a minimum along double scores 69', 70', and score 72'.

As can be seen in FIG. 13, a blank 90' adapted to be used in conjunction with a plurality of pedestals 100 will have a plurality of longitudinal scores 102 in the top sections 20'', 21'' thereof parallel to the second scores 18'', 19'' which define the outer edges of the cot. As a result, the upper surface 99' can be curved to conform with the curve of the upper edge 61' of the pedestal formed from the blank 100. As a result, a cot having pedestals from blanks 100 and a top from a blank 90' will be curved so as to provide a surface which will conform to the curve of a reclining human body.

It should be apparent that although the blanks 60, 100 are described as having double scores 69, 70, 69', 70' positioned substantially midway between the outer edges of the blank 60, 100, the double scores can be positioned between any two sections 77, 78, 79, 80. When the outer edges 64, 65 of the second blank 60, 100 are attached to each other, the sections adjacent the edges 64, 65 become adjacent each other. Regardless of the location of the double scores, the sections of the blank 60, 100 adjacent the double scores should be a little longer than the remaining two sections.

While the present invention has been described in connection with two embodiments, it will be apparent to those skilled in the art that many modifications and changes thereto may be made without departing from the true spirit and scope of the invention. Therefore, it is the intent of the appended claims to cover all such changes and modifications which come within the true spirit and scope of the invention.

What is claimed:

1. A plurality of blanks of stiff foldable material for assembly into an item of furniture comprising in combination:

a first blank having a pair of opposing edges, a first score positioned midway between said opposing edges, two second scores, one of said second scores on each side of said first score to define first and second top sections separated by said first score, two third scores, each of said third scores positioned between adjacent ones of said second scores and of said opposing edges to define a first and a second side sections and first and second support sections, said first side section adjacent said first top section, said first support section adjacent said first side section, said second side section adjacent said second top section, and said second support section adjacent said second side section, each of said side sections having at least one cut out portion therein, each cut out portion having a base portion extending along a portion of one of said third scores, said first blank adapted to be folded along said second scores and said third scores to form the top of said item of furniture and said cut out portions of said first side section mating with cut out portions of said second side section to form at least one opening for receiving a pedestal, at least one second blank having a pair of opposing outer edges and having a plurality of scores defining a plurality of sections in side-by-side relationship between said outer edges, each of said second blanks having at least four sections, means for joining said outer edges of each said blank to form a pedestal therefrom, a first and a second section of said second blank being adjacent each other, when said outer edges are joined together, said first section having a width a little wider than the width of a third section and said second section having a width a little wider than the width of a fourth section, and said score between said first and said second sections of said assembled pedestal being a double score for folding said first and said second section around said third and said fourth section for the purpose of shipping.

2. A plurality of blanks of foldable material in accordance with claim 1 wherein said first score in said first blank is a double score, and said blanks are made of corrugated cardboard.

3. A plurality of blanks of foldable material in accordance with claim 2 wherein a height of said second blanks are substantially equal to the width of said first and second support sections.

4. A plurality of blanks in accordance with claim 1 wherein said second blanks have curved upper edges.

5. A plurality of blanks of foldable material in accordance with claim 4 wherein said first and said second top section have a plurality of longitudinal scores therein.

6. A plurality of blanks of foldable material in accordance with claim 1 wherein said first blank further has two fourth scores, one of said fourth scores positioned between adjacent ones of said third scores and said opposing edges to define a first and a second reinforcing section, said first reinforcing section adjacent said first support section and said second reinforcing section adjacent said second support section.

7. A plurality of blanks of foldable material in accordance with claim 6 wherein said first score in said first blank is a double score, and said blanks are made of corrugated cardboard.

8. A plurality of blanks of foldable material in accordance with claim 7 wherein a height of said second blank is substantially equal to the width of said first and second support sections.

9. A plurality of blanks in accordance with claim 7 wherein said second blanks have curved upper edges.

10. A plurality of blanks of foldable material in accordance with claim 9 wherein said first and said second top sections have a plurality of longitudinal scores therein.

11. A plurality of blanks of stiff foldable material for assembly into an item of furniture comprising in combination:

a first blank having a pair of opposing edges, two spaced first scores, said spaced first scores positioned between said opposing edges on said first blank to define a top section, two second scores, each of said second scores positioned between adjacent ones of said first scores and of said opposing edges to define a first and a second side sections and first and second support sections, said first side section and said second side section positioned one on each side of said top section, said first support section adjacent said first side section, and said second support section adjacent said second side section, each of said side sections having at least one cut out portion therein, each cut out portion having a base portion extending along a portion of one of said second scores, said first blank foldable along said first scores and said second scores to form the top of said item of furniture and said cut out portions of said first side section mating with cut out portions of said second side section to form at least one opening for receiving a pedestal, at least one second blank having a pair of opposing outer edges and having a plurality of scores defining a plurality of sections in side-by-side relationship between said outer edges, each of said second blanks having at least four sections, means for joining said outer edges of each said blank to form a pedestal therefrom, a height of said second blank being substantially equal to a width of said first and second support sections.

* * * * *

UNITED STATES PATENT AND TRADEMARK OFFICE

CERTIFICATE OF CORRECTION

PATENT NO. : 5,394,810

DATED : March 7, 1995

INVENTOR(S) : John R. Howard

It is certified that error appears in the above-identified patent and that said Letters Patent is hereby corrected as shown below:

In column 6, line 50, after "respectively" insert -- . --.

In column 8, line 60, "said" second occurrence, insert -- second --.

Signed and Sealed this

Thirtieth Day of May, 1995

Bruce Lehman

*Attest:*

BRUCE LEHMAN

*Attesting Officer*

*Commissioner of Patents and Trademarks*